US011332939B2

(12) United States Patent
Visitsak et al.

(10) Patent No.: US 11,332,939 B2
(45) Date of Patent: May 17, 2022

(54) INDIRECT LIGHT SKYDOME WITH NATURAL VENTILATION

(71) Applicants: Sopa Visitsak, Nonthaburi (TH); Nattaree Sridaranon, Bangkok (TH)

(72) Inventors: Sopa Visitsak, Nonthaburi (TH); Nattaree Sridaranon, Bangkok (TH)

( * ) Notice: Subject to any disclaimer, the term of this patent is extended or adjusted under 35 U.S.C. 154(b) by 0 days.

(21) Appl. No.: 17/046,772

(22) PCT Filed: Apr. 10, 2019

(86) PCT No.: PCT/TH2019/000008
§ 371 (c)(1),
(2) Date: Oct. 10, 2020

(87) PCT Pub. No.: WO2019/199242
PCT Pub. Date: Oct. 17, 2019

(65) Prior Publication Data

US 2021/0164229 A1 Jun. 3, 2021

(30) Foreign Application Priority Data

Apr. 10, 2018 (TH) ..... 1801002183

(51) Int. Cl.
*E04D 13/03* (2006.01)

(52) U.S. Cl.
CPC ..... *E04D 13/033* (2013.01); *E04D 13/0325* (2013.01); *E04D 2013/034* (2013.01)

(58) Field of Classification Search
CPC ..... E04D 13/0325; E04D 13/033; E04D 2013/034; E04D 2013/0345
See application file for complete search history.

(56) References Cited

U.S. PATENT DOCUMENTS 4,190,987 A * 3/1980 Naidus ..... E04D 13/03 49/1
4,307,549 A * 12/1981 Clanton ..... E04D 13/0305 52/1

(Continued)

FOREIGN PATENT DOCUMENTS

CN 1399095 A 2/2003
CN 203980134 U 12/2014

(Continued)

OTHER PUBLICATIONS

International Search Report and Written Opinion of the International Searching Authority of PCT/TH2019/000008 dated Aug. 21, 2019.

*Primary Examiner* — James M Ference
(74) *Attorney, Agent, or Firm* — Thomas | Horstemeyer, LLP

(57) ABSTRACT

An indirect light skydome with natural ventilation for building roofs consists a half sphere dome with a curved brim (101) and an air vent (102) around the dome (100), which attached to the horizontal circular base ($_6$) with a fan shape opening to allow only indirect sunlight and connected to the tube for light transmission inside the building. The dome (100) is divided into transparent part (1) for receiving only indirect light and opaque part (2) for direct light protection, which are made into a single dome using a coating technique to prevent rainwater leakage in the joints. The shading part and the fan shape opening correspond to the sun's angle for effective direct light protection during the daytime and all year round. The air vent (102) is designed for effective air flow for stack and cross ventilation in all directions. The indirect light skydome with natural ventilation helps to reduce heat and increase quality of daylight.

8 Claims, 5 Drawing Sheets

(56) References Cited

U.S. PATENT DOCUMENTS 4,428,358 A * 1/1984 Adamson ..... E04D 13/03 126/606
4,730,552 A * 3/1988 Murray ..... B60H 1/262 454/250
4,762,160 A * 8/1988 Bechtold ..... E04D 13/033 160/265
5,435,780 A * 7/1995 Ayles ..... E04D 13/03 454/199
6,052,956 A 4/2000 Hoy et al.
6,138,738 A * 10/2000 Moller ..... E06B 9/40 160/98
6,142,645 A * 11/2000 Han ..... E04D 13/0325 362/147
6,155,008 A * 12/2000 McKee ..... E04D 13/0325 52/198
6,385,922 B1 * 5/2002 Mors ..... E04D 13/03 52/173.3
6,827,445 B2 * 12/2004 Abe ..... E04D 13/033 353/3
7,185,464 B2 * 3/2007 Bracale ..... F21V 5/02 52/200
7,487,620 B2 * 2/2009 West ..... E04D 13/0325 52/200
8,111,460 B1 * 2/2012 Huang ..... F21S 11/00 359/591
9,194,128 B1 11/2015 Fawley et al.
9,976,308 B1 * 5/2018 Gelbaum ..... E04D 13/033
2005/0005541 A1 1/2005 West
2011/0252726 A1 * 10/2011 McLain ..... E04D 3/24 52/200
2011/0252727 A1 * 10/2011 McLain ..... E04D 3/364 52/200
2011/0289870 A1 * 12/2011 Nemazi ..... E04D 13/0315 52/200
2012/0134170 A1 * 5/2012 Bracale ..... E04D 13/033 362/555
2012/0233941 A1 * 9/2012 McLain ..... E04D 13/0315 52/200
2013/0086853 A1 * 4/2013 Brandalik ..... E04D 13/03 52/200
2013/0135744 A1 * 5/2013 Jaster ..... G02B 17/00 359/597
2013/0333312 A1 * 12/2013 Fooks ..... E04D 13/0315 52/200
2018/0135304 A1 * 5/2018 Gelbaum ..... E04D 13/033
2019/0145105 A1 * 5/2019 Reyburn ..... F24F 7/02 454/199
2019/0203474 A1 * 7/2019 Burkes ..... E04D 13/033
2019/0203475 A1 * 7/2019 Burkes ..... E04D 13/033
2021/0164229 A1 * 6/2021 Visitsak ..... E04D 13/0325

FOREIGN PATENT DOCUMENTS

CN 205560629 U 9/2016
CN 206091107 U 4/2017
CN 106642008 A * 5/2017 ..... E04D 13/0325
CN 207073219 U 3/2018
GB 879927 A * 10/1961 ..... E04D 13/03
WO 9421871 A1 9/1994

* cited by examiner

INDIRECT LIGHT SKYDOME WITH NATURAL VENTILATION

TECHNICAL FIELD

Fields of engineering and architecture related to indirect light sky dome with natural ventilation especially for skylights, shading devices, and natural ventilation for buildings.

BACKGROUND ART

From the past to the present, the design of buildings by utilizing natural light could be done through the top and side openings. The devices and materials commonly used to get natural light from the roof at the area that has insufficient lighting are skylight, which normally glass or transparent skylight are used to get direct light for examples: Skylight Device, U.S. Pat. No. 6,052,956 (Apr. 25, 2000), which is the horizontal clear glass exposure; Sky Dome Device, U.S. Pat. No. 440,822 (Oct. 11, 1983), which is the clear glass dome; and Light Pipe, U.S. Pat No. 7,185,464 (Mar. 6, 2007), which obtains direct sunlight through the clear glass dome at the top to converge the sunlight into the components and refracts the light in the pipe to reduce glare. However, the heat from the direct sunlight passing through the surface of the transparent material the will be collected inside the device and then spread under the roof. Therefore, the conventional glass skylights and light pipes are generally not suitable for tropical climate countries such as Thailand due to the devices will increase the heat accumulation in the buildings. Sun shadings for skylights have been further developed for examples: U.S. Pat. No. 4,762,160 (Aug. 9, 1988), which is the shading device for skylight; and U.S. Pat. No. 6,138,738 (Oct. 31, 2000), which is the adjustable shading device for window skylight that looks like sunscreen or blinder to bring in natural light or to protect direct sunlight when prefer. However, it is inconvenient for building users to control the device according to each period that requires sunlight or need to protect direct sunlight. Skylights with control systems (sensors) that detect the direction of the movement of the sun were developed to control the sunlight exposure and protection. Parts of the devices are used to refract light or automatically adjust the angle relative to the direction of the sun, for examples: U.S. Pat. No. 6,827,445 (Dec. 7, 2004), which is the sunlight device with solar tracking system; and U.S. Pat. No. 8,111,460 (Feb. 7, 2012), which is the solar tracking system for illumination. The production cost and production processes of the devices with solar tracking systems are high and result in the products are highly priced. In addition the products also need electricity for sensors. Therefore, the investments of these products might not be cost effective for some building such as residential buildings.

Nowadays, there are skylight products with additional ventilation systems, for examples: U.S. Pat. No. 4,428,358 (Jan. 31, 1984), which is the solar energy skylight that has a clear glass window with a large two-sided slant that opens directly to the building below. There is a mechanism for adjusting the exposure in the form of a plate and a rotating rod that moves in the triangle to turn off the exposure according to the season and adding a small air vent at the top cover area of the optical frame in the extended section along the two sides as a slatted slit in the bottom of the installation. The structure is V-shaped. In terms of ventilation, because it is a clear glass window, large in length that receives direct light and there is a small vents in the narrow position on both sides which has quite a lot of distance between each other and may cause ventilation performance not as good as it should be due to the size of the small vents and in the side position extending from the chassis causing the hot air to accumulate inside the building flowing through the vent to the outside on both sides quite slowly.

U.S. Pat. No. 7,487,620 (Feb. 10, 2009), which is the skylight with wind controlled ventilation system. It is a curved shape device with transparent material to obtain direct sunlight and vertical air ventilation that can be turned on and off. The type of this ventilation is a single point of ventilation during the time when there is no wind outside. Hot air inside the building will be removed outside through the opening. But at certain times that there is wind from outside in the direction that blows against this vent may cause the hot air inside the building to not be able to be drained due to the external wind force. Therefore, having a single air vent can result in poor ventilation performance and the pattern of opening the vent in vertical or inclined degrees may cause problems from rainwater entering into the building, which is not suitable for use in the rainy countries.

For Thailand, transparent or translucent roof tiles are commonly installed above the areas that require natural light to reduce electricity use for lighting. However, such method may cause problems due to the amount of heat from direct radiation that enters and accumulates in the building. The heat increases cooling loads and energy usage for air conditioning system, which in total may not real energy savings. Therefore, the invention of this indirect light and ventilated dome device was designed to solve such problems. The design using the principle of shading and calculations that correspond to the direction of the sun's orbit that crosses the Earth and the sky throughout the year making the device looks like a dome shape with transparent parts for indirect light and opaque parts to prevent direct sunlight that falls on the roof top to get into the building at the beginning. Therefore, only indirect light or diffused light can pass through the device into the building, thereby the reduction of heat and ultraviolet radiation that comes with direct sunlight. The device can prevent direct radiation at any time throughout the year without using other equipment or sensors to adjust the shading device to detect positions of the sun, which could also help to reduce production and maintenance costs. Moreover it is convenient for building users due to there is no need to adjust or control the device. In addition, the circular air vent around the dome for any wind directions was combined in the design to improve the effectiveness of removing the heat accumulated in the building through the upper part of the roof resulting in increasing of energy savings, thermal and visual comfort conditions in the building, as well as reducing of glare and ultraviolet radiation significantly. The daylight passing into the building is in good quality, which is soft and consistence in the range of indoor illumination standards.

In development, the new shape, and production techniques were designed to increase the efficiency of illumination and to reduce the indoor temperature better than the previous invention of the inventors, Thailand patent application number 1101000591 (Apr. 28, 2011), a skylight and shading device set, which was originally a dome shape, partially dissected, and without vents. The dome consists of 2 pieces of materials, which is an opaque partial dome shape combined with a nearly semicircular transparent sheet used to prevent rainwater and receiving sunlight surface. Therefore the device was developed into a new full dome form with the shading, transparent, and opening parts correspond to the previous invention, which results in a better amount of illumination. Additional ventilation system around the device also helps to reduce internal temperature more than the previous invention. The conclusions are from comparing the test results using temperature and illuminance sensors. Air vent around the device for heat removing to the outside helps to extend the lifetime of the materials used to produce the dome. For examples: The use of clear acrylic material blowing up to form the dome, the full form with air vent help to reduce deterioration of material due to exposure to the heat of sunlight better than the previous invention, which is a partial dome that without air vent. From the air flow measurement results, the design of the horizontal circular air vents in all directions at the lower part of the dome has better air flow than the design of vertical air vents in a specific direction. It also helps to reduce problems from rainwater better than vertical air vent types.

The aim of this invention is an invention related to indirect light sky dome and natural ventilation for building's roofs that uses the principles of shading design and theory of sun's orbit together with passive natural ventilation system of the device, which consists of 4 main parts as follows:

1. The skylight dome, which is a dome with curved brim around the base of the dome. North part of the dome is transparency to receive indirect light or diffuse light and the south part of the dome is opaque to protect the direct sunlight.

2. The horizontal circular base with the opening fan shape to receive indirect light or diffuse light to pass down the bottom. The upper part of the horizontal circular base is under the cover of the dome and is the part that supports the dome part. The circular base with the extended support plates are held flat in order to support and attach to the curved brim of the dome by tightening nuts and bolts. The support plates are also the support of the ring screens for dust and insects proof, which are installed around the edge of the curved brim for natural ventilation and for all wind directions around the dome.

3. The light transmission part acts as a connecting piece of light from the top into the internal area of the building and serves as a supporting part attached to a horizontal circular base, which may be shaped like a pipe.

4. The ring screen(s) for dust and insects proof to install around the edge of the curved brim, may be one ring-shaped screen covering all around the vent or separating the parts of ring-shaped screen into pieces according to the number of the support plates of the horizontal circular base used to support and attach to the partial ring screens.

To install this device on the roof, it is necessary to adjust the horizontal direction to allow the transparent part of the dome to receive sunlight from the north sky (the opaque part is on the south side) and adjusts the fan shape aperture to the south. In order to protect direct sunlight effectively, this dome should not be tilted along the angle of the roof The dome must be installed horizontally parallel to the ground and then attach the circular base to the cylinder tube and fasten the dome to the circular base by tightening the nuts and the bolts. Therefore, it is a fixed type device. Users do not have to adjust or rotate the device during use.

The aim of this invention is to develop a fixed type skylight for indirect sunlight-receiving along with passive natural ventilation system for building roofs, which can protect direct sunlight during sunrise to sunset all year round as well as distribute uniform light, reduce wind problems, able to ventilate when there is wind blowing and without wind (still air), reduce rainwater problems entering into the interior, without using any mechanism, electronic devices, or sensors for controlling the system that cause energy consumption. Therefore, the device helps to save energy in the building in terms of reducing the use of electricity for lighting in the daytime and removing the hot air that accumulates inside the building through the upper openings causing decrease of internal temperature and resulting in reducing the work load of air conditioners. Building users can look through the openings to see the outside scenery safely without the problems of direct light that may be harmful to the eyes. The device is convenient to use due to building users do not have to control or adjust the device at different times when the sun position changes. The product does not need advanced technology in production processes. The sunlight that passes through the device into the interior of the building is uniform indirect sunlight that looks soft and smooth. It helps to protect the eyes and skin of the building users and helps reduce the deterioration of furniture and building decoration materials from the harmful effects of ultraviolet (UV), which affects building users to have better health and well-being.

DISCLOSURE OF INNOVATION

FIG. 1 shows the indirect light skydome with natural ventilation for building roofs, which consists of a skylight dome (100), a horizontal circular base (6) with a fan shape opening (4), an air vent (102)

The skylight dome (100) looks like a dome with curved brim (101) connected around the base of the dome. There is a transparent part (1) (for receiving indirect light or diffuse light from the north side) and with an opaque part (2) (for protecting direct light from the south). The appropriate technique for producing the dome (100) is forming a transparent material into one piece and coating by spraying, painting, or plastering the opaque material over the opaque part (2) without having to put two pieces of material (transparent-opaque) together to avoid the leakage of rainwater in the jointed areas of both materials.

The horizontal circular base (6) is a structure with a flat surface at the top (5) and a fan shape opening (4) to receive the sunlight that passes down to the bottom. The upper part of the horizontal circular base (6) is under the cover of the skylight dome (100). The horizontal circular base (6) smaller than the diameter of the skylight dome (100). At the curved brim area (101) creates an opening area under and around the base of the dome acts as an air vent (102) for ventilating hot air inside the building to the outside. The suitable horizontal circular base (6) is a circular plate with the radius of the circular plate equals to the radius of the dome above the curved brim. The design makes it possible to have a partial view of the sky through the fan shape opening (4) and the transparent part (1) of the skylight dome (100) without harmful to the eyes due to it is the area without direct sunlight, which allows building users to feel connected to the external environment.

The air vent (102) positioned horizontally under and around the base of the dome is suitable and better for protection of rainwater that may leak inside than a vertical vent. It is combined with the passive ventilation system is a natural ventilation method using the heat effect caused by temperature differences (Stack effect ventilation). The hot air inside the building will rise to a high position and vent to the outside through the air vent of the device, which can ventilate the hot air to the outdoor when there is wind and without wind (still air). When there is wind blowing, the design of opening area surrounding the device results in effective ventilation due to the air can flow through the openings regardless of the direction of the wind. The wind blowing from one direction will help blow the hot air floating in the area under the dome blowing into the opposite direction (Cross ventilation). When there is without wind (still air), the hot air inside the building will float to the top and release outside in all directions and causing the temperature inside the building to decrease as well as enhancing helping the residents of the a better well-being for building users. In additions, due to the device is a curved dome shape and surrounding with the air vent (102), it allows wind to blow through and helps to reduce the occurrence of wind lift problems.

FIG. 2 shows the elements of the horizontal circular base (6) and the installation of the device. The horizontal circular base (6) consists of a fan shape opening (4) flat surface (5) at the top. The fan shape opening (4) has a triangle angle in the position corresponding to the center of the radius of the upper dome. The fan shape angle (13) that is angled between 132-180 degrees and placed to the opposite side of the transparent part (1) (by placing it to the south) in a symmetrical manner, left-right. The most suitable fan shape angle (13) is the angle of 132 degrees, which is the horizontal angle obtained by calculating the position of the sun's rays of Thailand. When it is combined with the vertical angle of the opaque part (2) of the skylight dome (100), it will be able to prevent direct radiation to be most effective throughout the daytimes from sunrise until sunset. The fan shape angle (13) at an angle more than 132 degrees (132-180 degrees) will reduce the effectiveness for direct light protection at certain times.

The flat surface (5) at the top is made of opaque material or translucent material that has a light transmittance of not more than 50 percent to filter the direct sunlight that will pass through the flat surface (5) at the top to the internal area. It is to reduce glare and heat from direct sunlight that may partially pass inside. For a building or area that requires more illuminance, the use of translucent material on the flat surface (5) will improve the illuminance level, but some of the heat that passes through the device will be a little more than using opaque materials.

FIG. 3 shows the section of the skylight dome (100), with the height of the dome (12) that is appropriate equals to or close to the horizontal radius of the dome without the curved brim (101). The opaque part (2) is designed according to the separation part for shading that is from calculating the angles of the sun, which are the angles between sun's rays and the horizon on the crisis date (Summer Solstice) The angle between the sun's ray and the perpendicular line at the center (10) and the angle between the sun's ray and the horizontal circular plane (11) are used to draw the shading line (3) for the end of the opaque part (2), which may be used as a coating opaque material over the opaque part (2) of the skylight dome (100), that is a transparent material forming into one piece.

The curved brim (101) is extended from the dome with the length of the brim (101) extended not more than half of the diameter of the dome measured horizontally from the edge of the diameter of the dome (or from the edge of the horizontal circular base) and the height of the curved brim not more than half of the diameter of the dome or the height of the dome (12).

The horizontal circular base (6) may be designed to be a cover for the upper part of the light transmission to the inside (9) for ease of turning the direction of the fan shape opening (4) to the right position during the installation process before fixing it. The horizontal circular base has the extended support plates, which are held flat in order to support and attach to the curved brim of the dome by tightening the nuts and bolts. The support plates are also used to support the ring screens for dust and insects proof, which are installed around the edge of the curved brim for natural ventilation.

The horizontal circular base (6) has a number of support plates (7) for support and installation with the skylight dome (100) at the curved brim of the dome. The support plates are extended from the horizontal circular base (6) in a position lower than the flat surface (5) in order to install the skylight dome (100) with the edge of the curved brim lower than the horizontal surface (5). The length of the extension is related to the size of the dome (100). It may be designed to have a dome mounting mechanism (103) at the outer edge of the support plates (7), which may be designed to have 2 edges. For the inner and outer domes, which may be designed for the inner edge to be embedded in the nuts for tightening. The outer edge has holes for inserting the bolts at the level that corresponds to the holes of the nuts at the inner edge by matching the aperture hole in the skylight dome (100) when placed on these support plates (7) and bonded together with the nuts. This may be designed to provide the support plate (7) with an anchor point (104) for fixing the ring screen for dust and insects proof (8), such as making a lodge button to be used to lock the frame of the grating that is punched on each side.

The support plates (7) may have a number between 2-6 plates and the most suitable number is between 3-4 plates for stability and strength for supporting the dome (100), which consists of ring screens for dust and insects proof (8) Installed on the support plates (7) in the area of air vent (102), designed to have a shape that is related to the air vent (102) and may be selected from a ring or partial rings. These dust and insects proof (8) are also help to reduce splashes of rain droplets that fall through the area of air vent (102).

The part for light transmission to the inside (9) may be shaped like a tube. It is a piece that connects the light from the top to the inside of the building and serves for installation the horizontal circular base (6). It is a 2-sided open end tube with a shape and size that is related to the installation of the horizontal circular base, in which the right shape is the cylinder shape. It may be designed to have the horizontal circular base (6) covering on the top end of the tube or the open end on the top of the tube has an inner edge that can be installed in a horizontal circular base (6) either or together for convenience and stability in installation, which may be adhered together by screws through the prepared bores of the horizontal circular base (6) and the part for light transmission to the inside (9).

The bottom open end of the part for light transmission section to the inside (9) may be designed to relate to the roof (14) that will be installed, which may choose from flat slab, corrugated tiles, curved tiles, metal sheets, monier tiles, one or the other.

FIG. 4 shows the installation of the indirect light skydome with natural ventilation on tilted roof, which can be designed to have the shape of the inclination angle of the protruding part in relation to the roof (14) or the length of the tube that is suitable for installation on the roof or tile roof, selected from the flat slab roof or tilted roof.

The flat slab is easy to install during the building construction due to the roof is not tilted. The length of the tube can be adjusted to be appropriate according to the tilted roof structure.

For the tilted roof, it can be designed the shape of the tube at the bottom end can be designed to connect into the same piece of the roof tile with the tilt angle according to the roof (14) to make it possible to stack over each other, for examples: corrugated tiles, curved tiles, metal sheets, monier tiles, etc., in order to be installed in line with the original roof tiles and adjust the inclination of the tube so that the dome can be mounted in the horizontal plane parallel to the ground. If it is an existing building and wants to install this device later, it can be done by removing some of the original roof tiles in order to install the dome to replace the tiles with overlapping tiles to reduce the problem of leakage of rain water and by avoiding the installation of equipment by means of drilling the original roof tiles into circles in order to put the cylinder tubes.

For the installation, the exposure angle have to be is adjusted by turning the horizontal circular base (6) to allow the opening of the fan shape on the south side. Indirect light dome that has been modified from the original design by adding in the air vent to be a full arched dome shape and with a curved brim to create an air vent around the dome. The prototype models and test boxes were developed in order to test and compare the illumination and thermal performances of this indirect light skydome with natural ventilation and the previous original design, the skylight and shading device set (without natural ventilation). The measurements showed the amount of light or illuminance levels inside the test box for this indirect light sky dome with natural ventilation were better than the results from the box for the previous original dome (Skylight and shading device set). From the comparison of the illuminance in the test boxes equipped with the original skylight and shading device set (without natural ventilation) and the indirect light skydome with natural ventilation, both of the domes had an equal fan shape opening area on the similar horizontal circular base. Data logger measuring instruments were installed at the center of the area at each level of 6 levels (Plane 1-6) from the floor level of the test boxes up to 200 cm with the height increments every 40 cm. The Illuminance values of each test box both were collected continuously every 10 minutes at each level and each day during the daytime period with the highest illuminance values, which was between 11:00 am-1:00 pm. The comparison of the illuminance results are shown as in Table 1.

TABLE 1

Comparison illuminance results at different levels of the test boxes for the skylight and shading device set (without natural ventilation), the previous invention, Thailand patent application number 110100059, and for the indirect light skydome with natural ventilation according to this invention.

| Daytime (Hours) | Previous invention, patent application no. 1101000591 (without natural ventilation) (Lux) | This invention Indirect light skydome (with natural ventilation) (Lux) | This invention—Previous invention (Differences) (Lux) |
|---|---|---|---|
| | Test boxes internal illuminance at floor level (Plane 1) Apr. 12, 2016 | | |
| 11:00 | 98.5 | 161.6 | 63.1 |
| 11:10 | 98.5 | 169.5 | 71.0 |
| 11:20 | 98.5 | 169.5 | 71.0 |
| 11:30 | 98.5 | 169.5 | 71.0 |
| 11:40 | 98.5 | 169.5 | 71.0 |
| 11:50 | 106.4 | 169.5 | 63.1 |
| 12:00 | 106.4 | 177.4 | 71.0 |
| 12:10 | 106.4 | 177.4 | 71.0 |
| 12:20 | 106.4 | 177.4 | 71.0 |
| 12:30 | 106.4 | 177.4 | 71.0 |
| 12:40 | 106.4 | 177.4 | 71.0 |
| 12:50 | 106.4 | 177.4 | 71.0 |
| 13:00 | 106.4 | 177.4 | 71.0 |
| Average Illuminance differences at floor level of the test boxes (Plane 1) | | | 69.8 |
| | Test boxes internal illuminance at 40 cm. level (Plane 2) Apr. 25, 2016 | | |
| 11:00 | 145.8 | 216.8 | 71.0 |
| 11:10 | 145.8 | 216.8 | 71.0 |
| 11:20 | 145.8 | 224.7 | 78.9 |
| 11:30 | 153.7 | 224.7 | 71.0 |
| 11:40 | 153.7 | 224.7 | 71.0 |
| 11:50 | 153.7 | 232.6 | 78.9 |
| 12:00 | 153.7 | 232.6 | 78.9 |
| 12:10 | 153.7 | 232.6 | 78.9 |
| 12:20 | 153.7 | 232.6 | 78.9 |
| 12:30 | 161.6 | 240.5 | 78.9 |
| 12:40 | 161.6 | 232.6 | 71.0 |
| 12:50 | 161.6 | 232.6 | 71.0 |
| 13:00 | 161.6 | 232.6 | 71.0 |
| Average Illuminance differences at 40 cm. level of the test boxes (Plane 2) | | | 74.6 |
| | Test boxes internal illuminance at 80 cm. level (Plane 3) May 3, 2016 | | |
| 11:00 | 224.7 | 319.3 | 94.6 |
| 11:10 | 224.7 | 319.3 | 94.6 |
| 11:20 | 232.6 | 335.1 | 102.5 |
| 11:30 | 240.5 | 335.1 | 94.6 |
| 11:40 | 232.6 | 335.1 | 102.5 |
| 11:50 | 240.5 | 335.1 | 94.6 |
| 12:00 | 232.6 | 327.2 | 94.6 |
| 12:10 | 248.3 | 350.8 | 102.5 |
| 12:20 | 248.3 | 350.8 | 102.5 |

TABLE 1-continued

Comparison illuminance results at different levels of the test boxes for the skylight and shading device set (without natural ventilation), the previous invention, Thailand patent application number 110100059, and for the indirect light skydome with natural ventilation according to this invention.

| Daytime (Hours) | Previous invention, patent application no. 1101000591 (without natural ventilation) (Lux) | This invention Indirect light skydome (with natural ventilation) (Lux) | This invention—Previous invention (Differences) (Lux) |
|---|---|---|---|
| 12:30 | 256.2 | 358.7 | 102.5 |
| 12:40 | 248.3 | 342.9 | 94.6 |
| 12:50 | 248.3 | 350.8 | 102.5 |
| 13:00 | 248.3 | 342.9 | 94.6 |
| Average Illuminance differences at 80 cm. level of the test boxes (Plane 3) | | | 98.2 |
| Test boxes internal illuminance at 120 cm. level (Plane 4) May 11, 2016 | | | |
| 11:00 | 342.9 | 461.2 | 118.3 |
| 11:10 | 342.9 | 461.2 | 118.3 |
| 11:20 | 342.9 | 461.2 | 118.3 |
| 11:30 | 350.8 | 469.1 | 118.3 |
| 11:40 | 350.8 | 461.2 | 110.4 |
| 11:50 | 366.6 | 484.9 | 118.3 |
| 12:00 | 366.6 | 484.9 | 118.3 |
| 12:10 | 366.6 | 484.9 | 118.3 |
| 12:20 | 366.6 | 484.9 | 118.3 |
| 12:30 | 366.6 | 477.0 | 110.4 |
| 12:40 | 366.6 | 484.9 | 118.3 |
| 12:50 | 374.5 | 484.9 | 110.4 |
| 13:00 | 374.5 | 484.9 | 110.4 |
| Average Illuminance differences at 120 cm. level of the test boxes (Plane 4) | | | 115.9 |
| Test boxes internal illuminance at 160 cm. level (Plane 5) May 13, 2016 | | | |
| 11:00 | 540.0 | 745.0 | 205.0 |
| 11:10 | 540.0 | 745.0 | 205.0 |
| 11:20 | 555.8 | 760.8 | 205.0 |
| 11:30 | 555.8 | 768.7 | 212.9 |
| 11:40 | 563.7 | 768.7 | 205.0 |
| 11:50 | 571.6 | 792.3 | 220.7 |
| 12:00 | 555.8 | 760.8 | 205.0 |
| 12:10 | 571.6 | 784.4 | 212.8 |
| 12:20 | 571.6 | 784.4 | 212.8 |
| 12:30 | 571.6 | 784.4 | 212.8 |
| 12:40 | 571.6 | 776.6 | 205.0 |
| 12:50 | 579.5 | 776.6 | 197.1 |
| 13:00 | 578.3 | 784.4 | 206.1 |
| Average Illuminance differences at 160 cm. level of the test boxes (Plane 5) | | | 208.1 |
| Test boxes internal illuminance at 200 cm. level (Plane 6) Jun. 4, 2016 | | | |
| 11:00 | 2219.3 | 2913.0 | 693.7 |
| 11:10 | 2187.7 | 2865.7 | 678.0 |
| 11:20 | 2306.0 | 3062.8 | 756.8 |
| 11:30 | 2250.8 | 2999.8 | 749.0 |
| 11:40 | 2156.2 | 2905.2 | 749.0 |
| 11:50 | 2235.0 | 3015.5 | 780.5 |
| 12:00 | 2463.7 | 3583.2 | 1119.5 |
| 12:10 | 2353.3 | 5877.3 | 3524.0 |
| 12:20 | 2313.9 | 3125.9 | 812.0 |
| 12:30 | 2313.9 | 4072.0 | 1758.1 |
| 12:40 | 2235.0 | 2913.0 | 678.0 |
| 12:50 | 2274.5 | 2968.2 | 693.7 |
| 13:00 | 2455.8 | 3267.8 | 812.0 |
| Average Illuminance differences at 200 cm. level of the test boxes (Plane 6) | | | 1061.9 |

From the comparison table for the luminance data above shows that for all positions (Planes 1-Plan 6), the illumination values of the test box equipped with the indirect light skydome with natural ventilation were higher than the illumination values of the test box equipped with the original skylight and shading device set (without natural ventilation). The average illuminance differences of the two test boxes increased from the original dome at floor level (Plane 1) was equal to 69.8 lux, at the level of 40 cm (Plane 2) was equal to 74.6 lux, at the level of 80 cm (Plane 3) was equal to 98.2 lux, at the level of 120 cm (Plane 4) was equal to 115.9 lux, at the level of 160 cm (Plane 5) was equal to 208.1 lux and at the level of 200 cm (Plane 6) was equal to 1,061.9 lux, respectively. Therefore, in conclusion, the indirect light skydome with natural ventilation, which is the full dome form with the curved brim around the dome for air vent together with the coating technique by spraying, painting, or coating opaque materials over the opaque part resulting in better internal illumination than the original skylight and shading device set, which is a partial dome form and without natural ventilation. Due to the curvature of the transparent part of the indirect light skydome with natural ventilation, which was developed to receive more indirect light and resulting in increasing of luminance level and better lighting efficiency. The illuminance levels that were measured at the work plane level (Plane 3) were averaged within the International Commission on Illumination (CIE) and the Illuminating Engineering Society (IES) Standards, which are the international standards of illumination. When comparing the illumination value with the device that receives the sunlight directly, it was found that the illuminance values measured from the test box equipped with the direct light device in the same aperture area exceeded the standards significantly, which implied the glare and heat problems.

As for the temperature comparison when testing the temperature measurement within the two test boxes compared in the same period by collecting data simultaneously every 10 minutes at the center of the test boxes and at the center position under the domes. It was found that in the daytime, the temperatures inside the indirect light skydome with natural ventilation box were mostly lower than the temperatures inside the original skylight and shading device set (without natural ventilation) box. The temperature measurements at the center of both test boxes were highest between 15:00 and 18:00. It was found that the temperatures inside the indirect light skydome with natural ventilation box were lower than the temperatures inside the original skylight and shading device set (without natural ventilation) box about 1 degree Celsius, as shown in FIG. 5. The temperature measurements at the center of the dome of both boxes were highest between 13:00 and 17:00. The temperatures at the center of the skylight dome with natural ventilation box were lower than the temperature at the center of the skylight dome without natural ventilation box about 10 degrees Celsius as shown in FIG. 6.

From the temperature comparison chart shown in the above, it can be concluded that the form of the new indirect light skydome, which has an additional natural ventilation system, could reduce the internal temperature better than the original skylight and shading device set without natural ventilation. In addition, in the case of testing that opened an opening at the bottom wall of the test box, which the area of the opening was close to the air vent of the dome and found that the average temperature differences within both test boxes were more than a test box that has no openings below as mentioned above due to the bottom opening provided better air flow, which was comparable to buildings that have windows will allow air to flow. The outside air will help blowing through the openings and bringing the hot air inside the building to the upper part and better venting outward.

In terms of the shape of the ventilation of the indirect light skydome, which looks like an air vent around the bottom of the dome, which was designed from the theory of air flow by designing an indirect light dome that was ventilated by natural methods in three different types in order to test and compare the efficiency of air flow to achieve a good ventilation pattern. The three indirect light dome types were: 1) the dome with the top vents out to the north 2) the dome with a top vent out to the south 3) the dome with a vent around the bottom edge. The amount of air flow and internal temperatures of the three different forms were measured and compared by installing each type of ventilation domes, placed on the top position of the test box with the sizing of 50×50×100 cm (width×length×height) and then installing an anemometer at the bottom of the box that drilled 1 inch diameter hole for 3 holes for air flowing out of the test box. An air velocity measuring instruments were installed. Each sensor head was placed at the center of each hole to finding an average air flow of the 3 positions. The channel for the wind to enter was in the vent of the domes installed on the top of the test box, which was installed the 3 different types of ventilation domes. The wind generator that could set the wind speed at different speeds at the same height as the dome was installed by placing about 1 meter away from the dome to test for the condition that the wind from outside blows the dome device. Then, the data were collected both in the case of air flow at normal room temperature and in the case of the internal temperature of the test box was set to 35 degrees Celsius, which was controlled by the lamp inside the test box in order to have a higher internal temperature. A temperature sensor was installed at the center of the test box and then the amount of air flow and temperatures in both cases were measured. This comparative air flow values in the case of the specified wind speed from the wind generator from 0, 2, 3 and 4 meters/second for every 20 seconds, 10 times, were collected and used to find the average air flow.

The results of comparative tests in various cases, together with the consideration of the shape that was convenient for rainwater entry into the building and convenient for the production of the work piece. Therefore, summarizing the result as a dome Type 3 (D3), the indirect light dome with air vent around the bottom of the dome, was the shape that had the best air flow. From the results of the air flow measurement test in the case of testing the air flow data that specified the wind speed from the wind generator at various speed levels in normal room temperature for comparing in each form and each direction that receives the external wind in front, back and side of the dome, it was found that the average volume of air flow of the dome type 3 (D3) was consistent with the flow of air in each direction to receive the air better than the others, and there was a tendency of increasing the air flow when the wind speed increased as shown in the graph FIG. 7. The results of the temperatures measured within the test box by setting the temperature inside the test box when starting to measure at 35 degrees Celsius. In determining wind speed from various wind generators, it was found that the average temperatures inside the test box equipped with dome type 3, from all 3 directions from the outside wind generator for each wind speed trended to have the maximum temperature drop as shown in the graph FIG. 8. It can be concluded that the shape of the indirect dome with ventilation at the lower part of the dome (type 3) has the best air flow due to the domes type 1 and type 2 were characterized by having only one vent or one position in which at the time there was no wind outside. The hot air inside will drain through the outside. But at certain times that there is wind from outside in the direction that blows against these vents. It may cause the hot air inside to not be able to be drained because there is higher external wind force. Therefore, having more than one vent in the direction or the vent that can drain in all directions (Dome type 3) will get better air flow efficiency than having a single air vent due to the wind blowing in the air vent at one point can blow away the hot air inside to the outside in the opposite direction as shown by the flow of air in FIG. 9. The third dome, which has the surrounding vent at the bottom of the dome, also has a form suitable for preventing the leakage of rainwater over the domes with air vents in the other positions.

Figure 1:
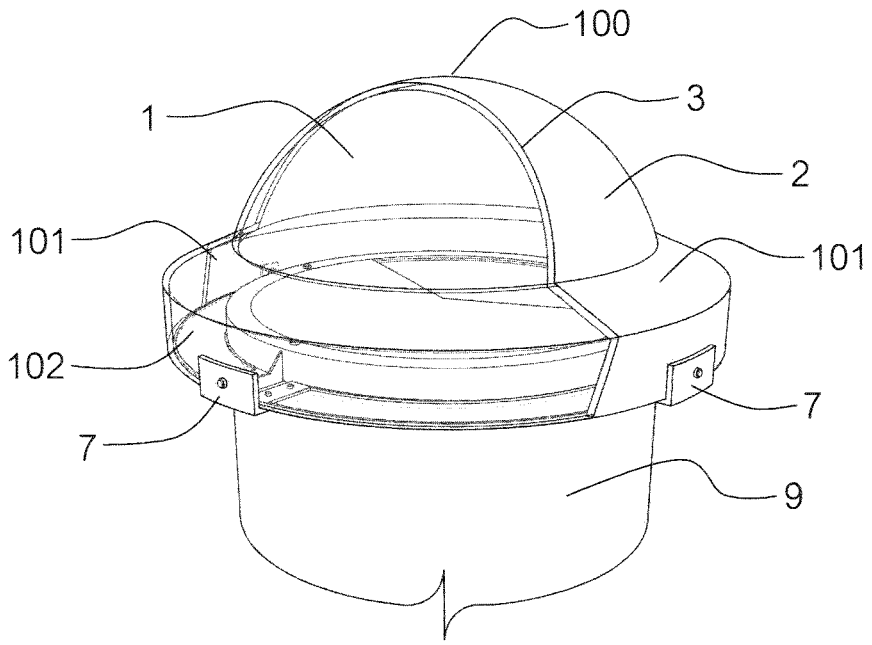
FIG. 1 shows the indirect light skydome with natural ventilation for building roofs
Figure 2:
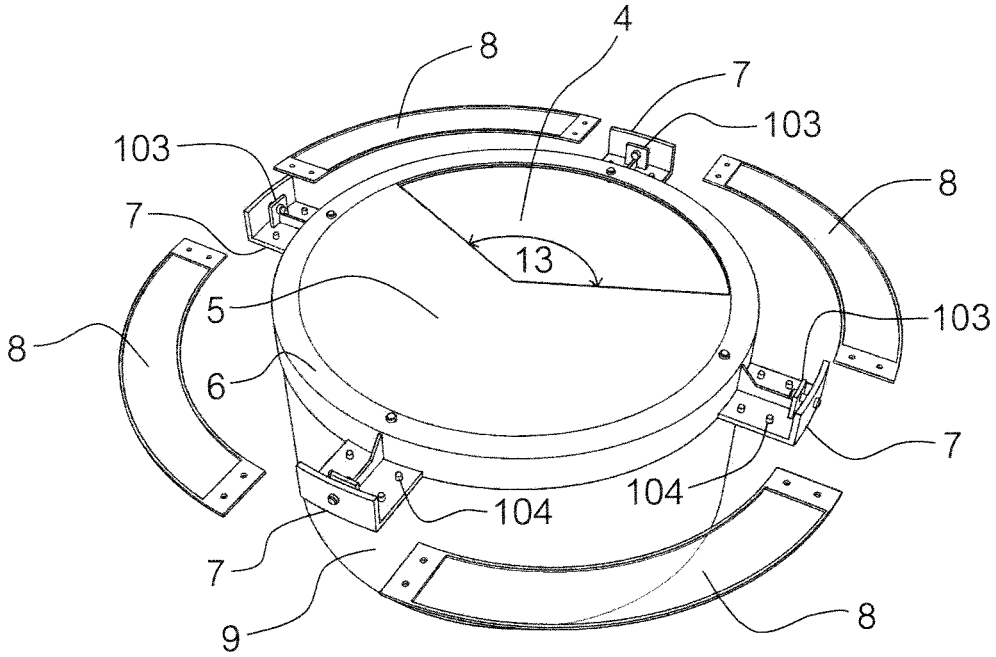
FIG. 2 shows the elements of the horizontal circular base and installation of the device
Figure 3:
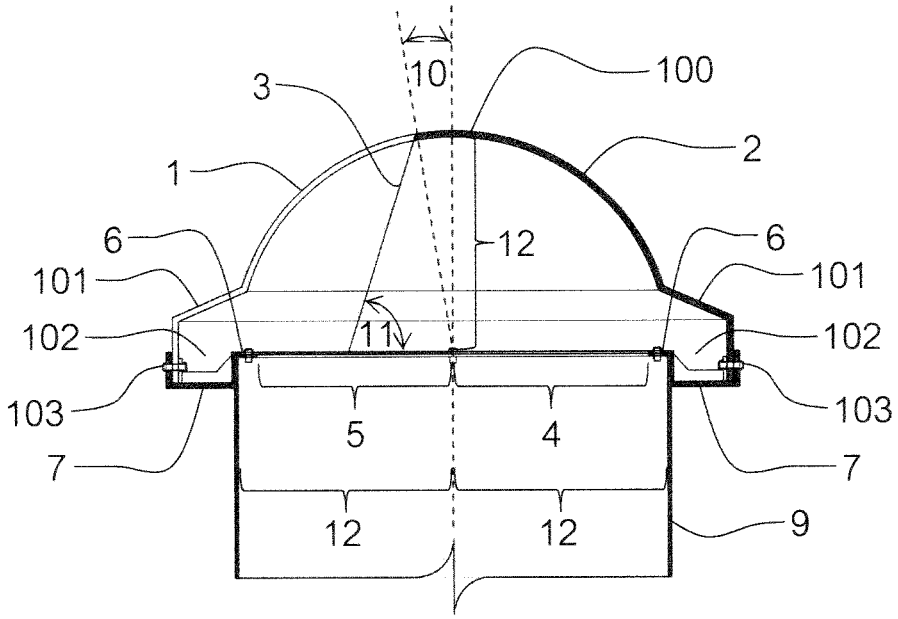
FIG. 3 shows the section of the skylight dome
Figure 4:
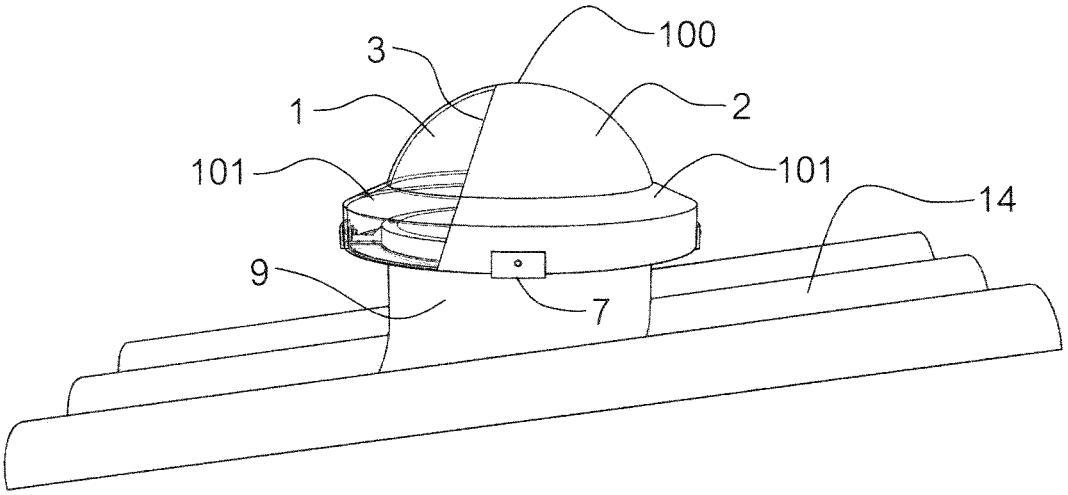
FIG. 4 shows the installation of the indirect light skydome with natural ventilation on tilted roof
Figure 5:
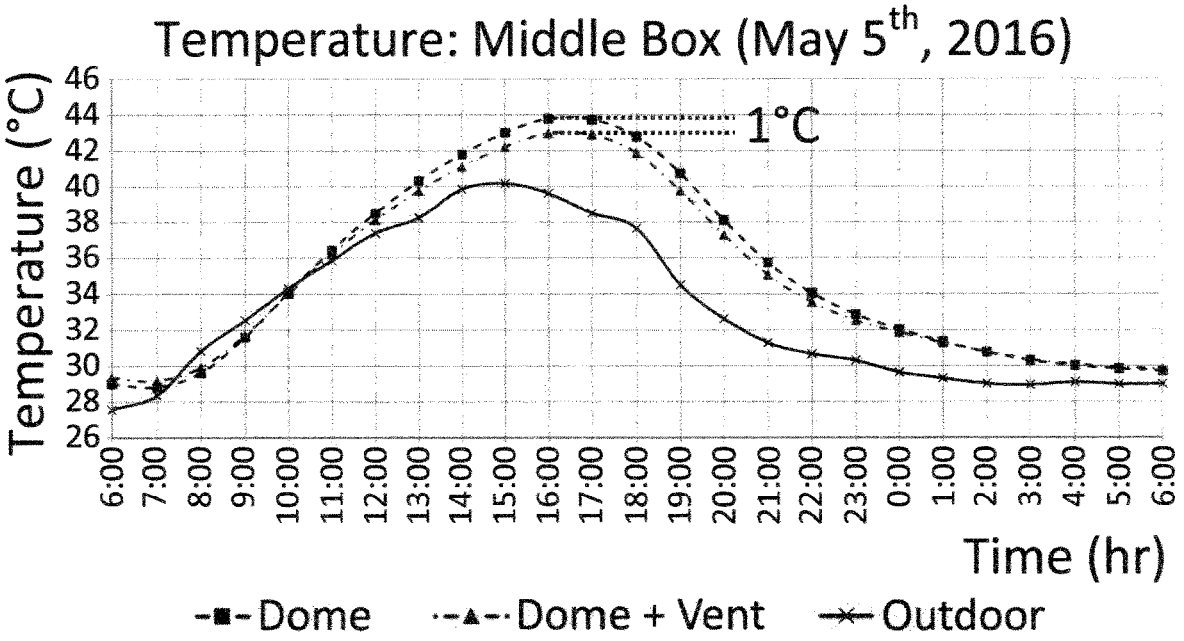
FIG. 5 shows temperature comparison chart inside the center of the two test boxes equipped with the original skylight and shading device (without natural ventilation) and the indirect light skydome with natural ventilation
Figure 6:
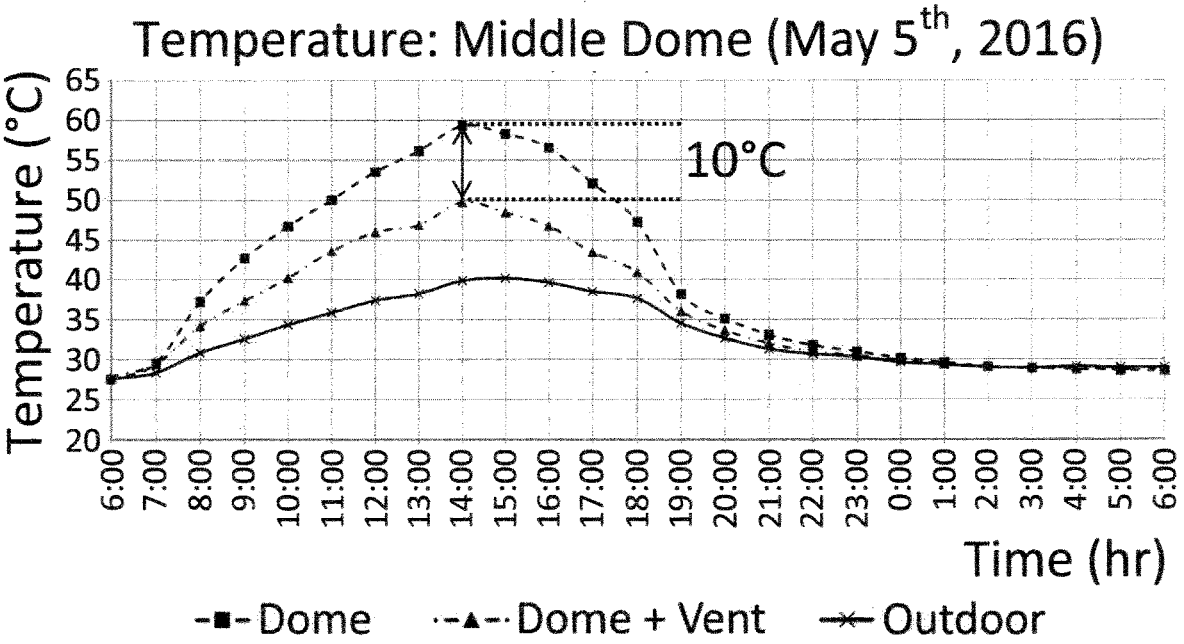
FIG. 6 shows temperature comparison chart inside the center under the original skylight and shading device (without natural ventilation) and the indirect light skydome with natural ventilation
Figure 7:
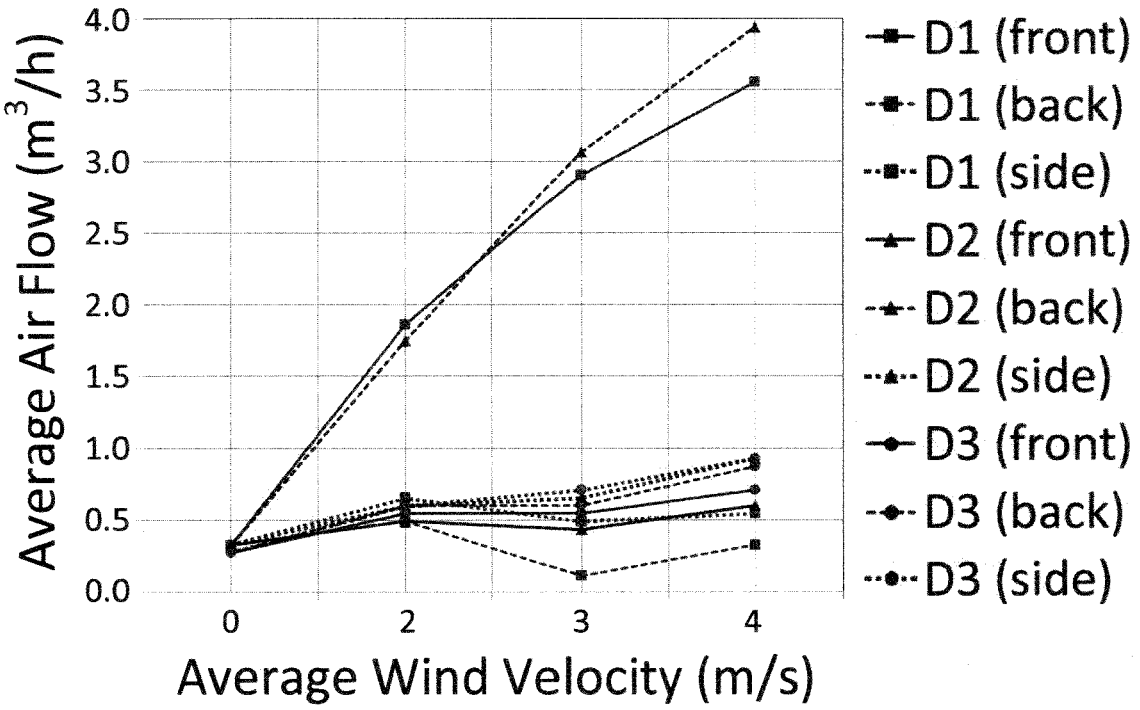
FIG. 7 shows comparison chart of air flow volume at room temperature at different wind speeds
Figure 8:
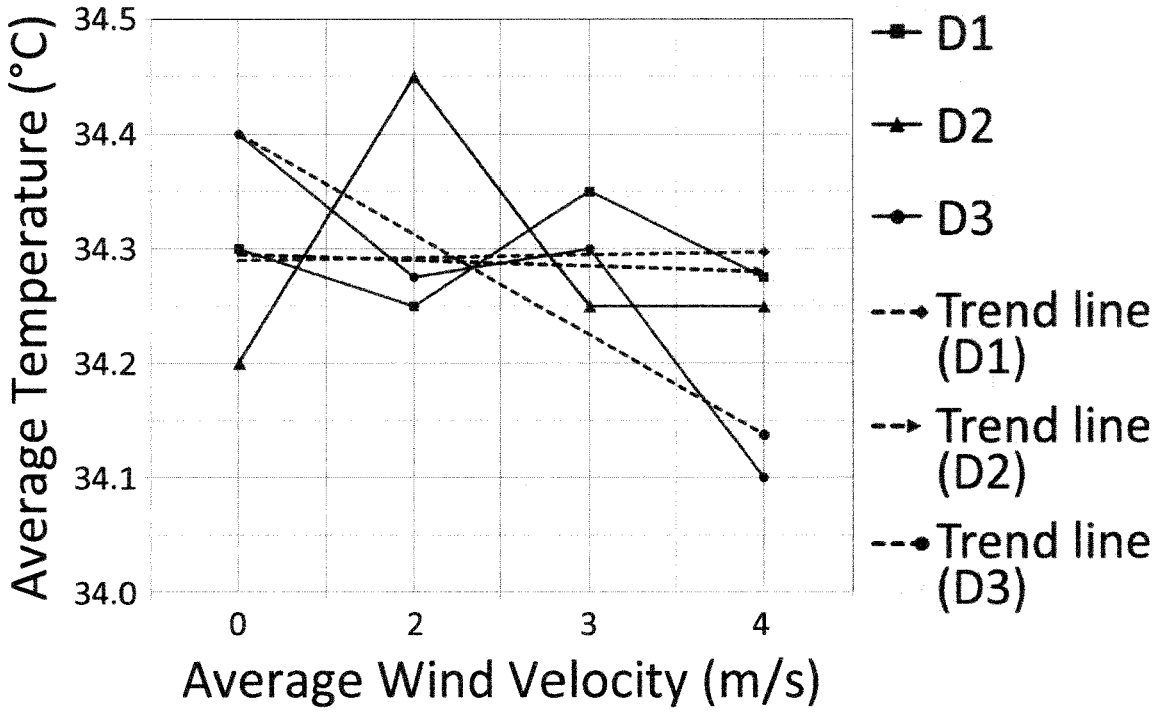
FIG. 8 shows temperature comparison chart in the middle of the test boxes at different wind speeds
Figure 9:
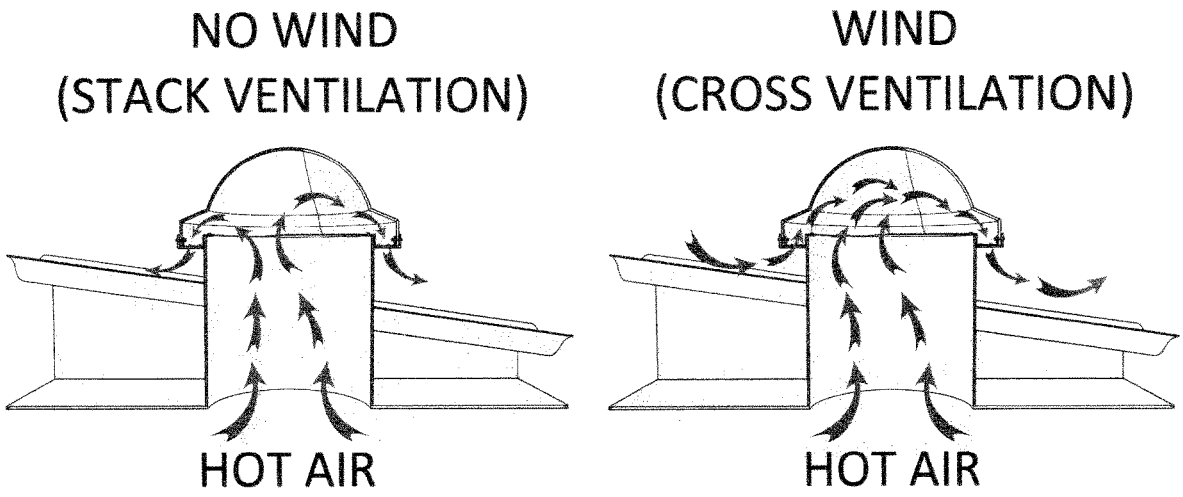
FIG. 9 shows the air flow at the conditions with external wind and without external wind

The invention claimed is:

1. An indirect light skydome with natural ventilation for installation on a roof, comprising:

a curved dome having a transparent part that receives indirect sunlight and an opaque part that prevents direct sunlight for use in dividing a part of a building that requires natural light and a part protecting against direct sunlight or direct rays according to a shading line determined using a vertical angle of an orbit direction of the sun, wherein the indirect light skydome is configured for installation such that the opaque part is on a south side;

a horizontal circular base to support the curved dome positioned under the curved dome and configured to lay flat with a part of a fan-shaped opening in the south side, with an angle at a center of the horizontal circular base being equal to 132 degrees, and being symmetrical left-right on sides of the part of the fan-shaped opening;

a tube-shaped component for light transmission to an inside of a building having the roof, wherein a mouth of the tube-shaped component connects to the horizontal circular base and a diameter of the mouth is less than a diameter of the horizontal circular base such that the horizontal circular base is placed on the mouth of the tube-shaped component for light transmission to the inside;

a ring screen for dust and insect proofing installed on the support plates that extend from the horizontal circular base near an air vent, wherein the skydome has a half-spherical form with a curved brim around a base of the skydome;

a surrounding air vent that permits hot air from the inside of the building to vent out in all directions and permitting external wind to blow through the skydome and direct hot air to an opposite direction wherein the surrounding air vent is positioned at a bottom of skydome to prevent rainwater from leaking into the of the building, wherein:

the transparent part and the opaque part are coupled into a same piece and at least one coating technique comprising spraying, painting, or coating opaque materials is applied over the opaque part of the skydome to prevent leakage;

the transparent part and the opaque part are formed of two different materials;

the opaque part of the coating is configured to be placed in a south position and the transparent part is configured to be positioned on a north side;

the horizontal circular base has a horizontal top surface that provides direct radiation protection having the fan-shaped opening for receiving indirect light; and the fan-shaped opening is angled between 132-180 degrees and placed to the opposite side of the transparent part.

2. The indirect light skydome with natural ventilation according to claim 1, wherein a length of the curved brim extending horizontally from an edge of a diameter of the skydome or from an edge of the horizontal circular base is not more than half of the diameter of the skydome, and a height of the curved brim is not more than half of the diameter of the dome or the height of the dome.

3. The indirect light skydome with natural ventilation for building roofs according to claim 2, wherein:

the horizontal circular base acts as a support and attaches to the skydome by the edge, the horizontal circular base having between one and seven support plates extending from the horizontal circular base; and a length of the support plates covers a mouth of the skydome and supports the curved brim of the skydome.

4. The indirect light skydome with natural ventilation according to claim 1, wherein the horizontal circular base has a round edge for placing a cover on the tube-shaped component to prevent rainwater entering the inside of the building and to adjust a direction of an aperture opening to a predetermined position in an installation process through adjustment of the fan-shaped opening area to the south side.

5. The indirect light skydome with natural ventilation for building roofs according to claim 1, wherein:

the horizontal circular base supports and is configured to be installed with the skylight dome at the curved brim of the skydome and supports the ring screen that is installed around the air vent under a mouth of the skydome at a lower position than the horizontal flat surface at a top of the skydome such that the skydome is able to be installed;

a dome mounting mechanism at the outer edge of a section in the support plates is provided having two edges for inner and outer domes, wherein an inner edge is embedded in nuts for tightening and an outer edge has holes for inserting bolts at a level that corresponds to the holes of nuts at the inner edge by matching an aperture hole in the skydome when placing on the supports bonding together with the bolts;

the support plate has an anchor point for fixing the ring screen; and a lodge button is provided to lock a frame of a grating that is punched on each side of the skydome.

6. The indirect light skydome with natural ventilation according to claim 1, wherein the ring screen has a ring-shaped covering, the air vent separating parts of the ring-shaped opening into pieces.

7. The indirect light skydome with natural ventilation according to claim 1, wherein:

a position of the horizontal circular base with the fan-shaped opening is in an area of the horizontal flat surface; and the opaque part is changeable to a translucent material to increase illuminance levels, a light transmittance not being more than fifty percent.

8. A method comprising providing the indirect light skydome according to claim 1.

* * * * *